US010123600B1

(12) United States Patent
Riley

(10) Patent No.: US 10,123,600 B1
(45) Date of Patent: Nov. 13, 2018

(54) PUMPKIN-SHAPED TRAVEL BAG ASSEMBLY

(71) Applicant: Kayla Lee Riley, San Diego, CA (US)

(72) Inventor: Kayla Lee Riley, San Diego, CA (US)

( * ) Notice: Subject to any disclaimer, the term of this patent is extended or adjusted under 35 U.S.C. 154(b) by 0 days.

(21) Appl. No.: 15/829,921

(22) Filed: Dec. 3, 2017

(51) Int. Cl.

| | |
|---|---|
| ***A45C 13/08*** | (2006.01) |
| ***A45C 7/00*** | (2006.01) |
| ***A45F 3/02*** | (2006.01) |
| ***A45C 13/10*** | (2006.01) |

(52) U.S. Cl.
CPC ..... *A45C 7/0086* (2013.01); *A45C 13/1076* (2013.01); *A45F 3/02* (2013.01)

(58) Field of Classification Search
CPC ..... B65D 33/008; A45C 13/08; A45C 7/0086
USPC ..... 383/4, 37; 190/108
See application file for complete search history.

(56) References Cited

U.S. PATENT DOCUMENTS

| | | | | |
|---|---|---|---|---|
| 1,947,542 | A | 2/1934 | Wheary | |
| 2,475,961 | A | 7/1949 | Heaton | |
| 2,493,506 | A * | 1/1950 | Schwartzbard | A45C 13/08 150/103 |
| 3,122,225 | A | 2/1964 | Ward | |
| 3,696,850 | A | 10/1972 | Rosenblum | |
| 4,081,061 | A | 3/1978 | Tucker | |
| 4,378,866 | A | 4/1983 | Pelavin | |
| 4,580,667 | A * | 4/1986 | Herwood | A45C 13/02 150/113 |
| 4,821,853 | A | 4/1989 | Young | |
| 4,887,700 | A | 12/1989 | Rice | |
| 5,050,713 | A | 9/1991 | Lee | |
| 5,234,143 | A | 8/1993 | Mahvi | |
| 5,305,935 | A * | 4/1994 | Weiner | G09F 3/20 224/277 |
| 5,311,972 | A | 5/1994 | Plath | |
| 6,227,339 | B1 | 5/2001 | Bogert | |
| 6,230,771 | B1 | 5/2001 | Hellenbrand | |
| 6,502,676 | B2 | 1/2003 | Dexheimer | |
| 6,619,447 | B1 | 9/2003 | Garcia, III | |
| 7,011,241 | B2 * | 3/2006 | Godshaw | A45C 7/0086 224/583 |
| 7,594,669 | B2 * | 9/2009 | Acosta | A63H 3/005 280/47.34 |
| 7,600,619 | B2 * | 10/2009 | Sapyta | A45C 7/0054 190/107 |
| 8,016,111 | B2 * | 9/2011 | Wilson | A45F 5/1046 206/493 |
| 8,109,672 | B1 * | 2/2012 | Ackerman | B65D 33/008 24/586.11 |

(Continued)

*Primary Examiner* — Sue A Weaver

(57) ABSTRACT

A bag assembly comprising of any number of detachable and re-attachable, wedge-shaped, independent, bag segments, that when collectively joined together, form a pumpkin-shape. The wedge-shaped, independent bag segments can be joined, at their top ends and their bottom ends, by each attaching to a detachable rings at the top and the bottom.

An inner pocket is included within each of the wedge-shaped, independent, bag segments. One or more detachable shoulder or hand straps can be applied and connect at either of the ends of the bag assembly for carrying purposes, or the strap can be attached directly to the bag segment. The detachable rings also serve as quick grab handles. Each of the wedge-shaped, independent bag segments have an exterior access entry.

6 Claims, 9 Drawing Sheets

(56) References Cited

U.S. PATENT DOCUMENTS

| | | | | |
|---|---|---|---|---|
| 8,429,852 | B1 * | 4/2013 | Fula | A01G 9/026 47/65.7 |
| 8,869,960 | B2 | 10/2014 | Mangano | |
| 2010/0320246 | A1 * | 12/2010 | Taylor | A45C 3/04 224/411 |
| 2012/0103481 | A1 * | 5/2012 | Nieves | A45C 3/06 150/113 |
| 2015/0001126 | A1 * | 1/2015 | Floyd-Vester | A45C 9/00 206/546 |

* cited by examiner

PUMPKIN-SHAPED TRAVEL BAG ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

FIELD OF THE INVENTION

This invention relates to luggage, and more particularly to a versatile, personal travel bag assembly.

BACKGROUND OF THE INVENTION

Historically, travel bags have taken their shape and function from the various transportation methods available for travel. People traveling by caravans or ships could generally rely on porters carrying their personal objects in heavy trunks or chests. Later, traveling by train, airplane or automobile would usher in hand carried suitcases, duffel bags, and backpacks. With an increasing on-the-go type modern society, travel bags are being tasked to accommodate more personal items, which have resulted in some updated features for convenience to the historical carriers.

Trunks and suitcases, can be bulky and heavy and designed in a manner, which creates a cavernous interior compartment, wherein personal items are apt to shift when opening and closing. In order to have some organization in the cavernous open interior compartment, an additional third-party packing organizer would need to be added. The resulting form of the suitcase is generally a hard-sided shape, and it is generally not subject to further compression or the overall shape being scalable.

Duffle bags are limited in organizing ability, and scalability. Backpacks can be complicated in their organizing ability, strapping systems, and offer limited scalability.

There are often times when airplane overhead space is limited, and filled with stiff luggage and there is limited space to store another traditional carrier. The ability to compress or scale the shape of a carrier amongst those conditions is an improvement to the current art. The present invention provides for the ability to compartmentalize belongings among various bag segments, which allows belongings to be packed in bag segments being stored in the overhead space, and having another bag segment specifically packed for belongings that could be accessible during transit without having to access the overhead space. A single bag segment could also be packed so as to use as a personal pillow.

When traveling there may arise the need for a smaller size bag to use instead of carrying the larger, fuller size travel bags know to the art. This invention meets the needs of a larger size bag, while allowing multiple independent detachable and re-attachable small bags.

Although various travel bags are known to the art, all, or almost all of them suffer from one or more than one disadvantages. Therefore, there is a need to provide a personal item travel carrier that can improve on internal compartmental challenges and optimize on form, fit, and function for modern, on-the-go travel needs. The present invention accomplishes these objectives.

BRIEF SUMMARY OF THE INVENTION

The present invention includes detachable and re-attachable, wedge-shaped, independent, bag segments that connect together to form a lightweight, scalable, ease of use, travel bag. Additionally, each of the independent bag segments when detached, form separate travel bags for customized scaling and utility.

The detachable and re-attachable, wedge-shaped, independent, bag segments of the present invention features a convenient access entry and exit opening in which to organize personal belongings. Personal belongings can be compartmentalized into each of the bag segments for easy organization and being able to access an item without disturbing the other packed items.

One or more flexible straps can be employed to carry the travel bag. With attachment points on both ends of the strap, the strap can be configured to carry the fully attached bags or the individual bag segments, over the shoulder or as hand held.

The rings that are attached to each of the travel bag segments, at the top and bottom ends of the travel bag segments, can also be utilized as quick-grab handles.

The present invention is a multi-use, scalable, aesthetically appealing, compact and easily transportable pumpkin-shaped personal travel bag, wherein the independent wedge-shaped bag segments can be easily detached and re-attached. Other features and advantages of the present invention will become apparent from the following more detailed description, taken in conjunction with the accompanying drawings, which illustrate, by way of example, the principles of the invention.

DETAILED DESCRIPTION OF THE INVENTION

Figure 5:
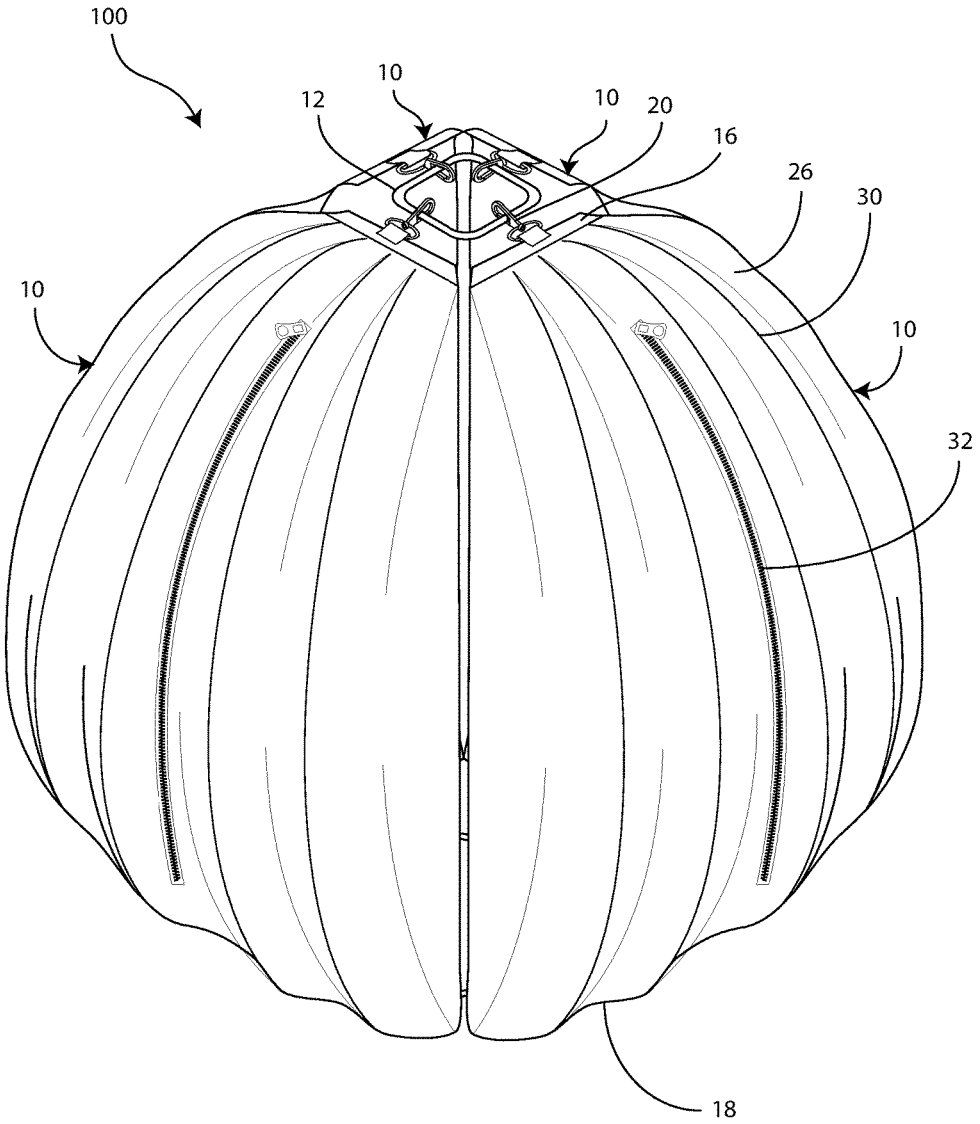
FIG. 5 is a perspective view of travel bag assembly with multiple wedge-shaped, independent bag segments connected at top and bottom rings.
Figure 6:
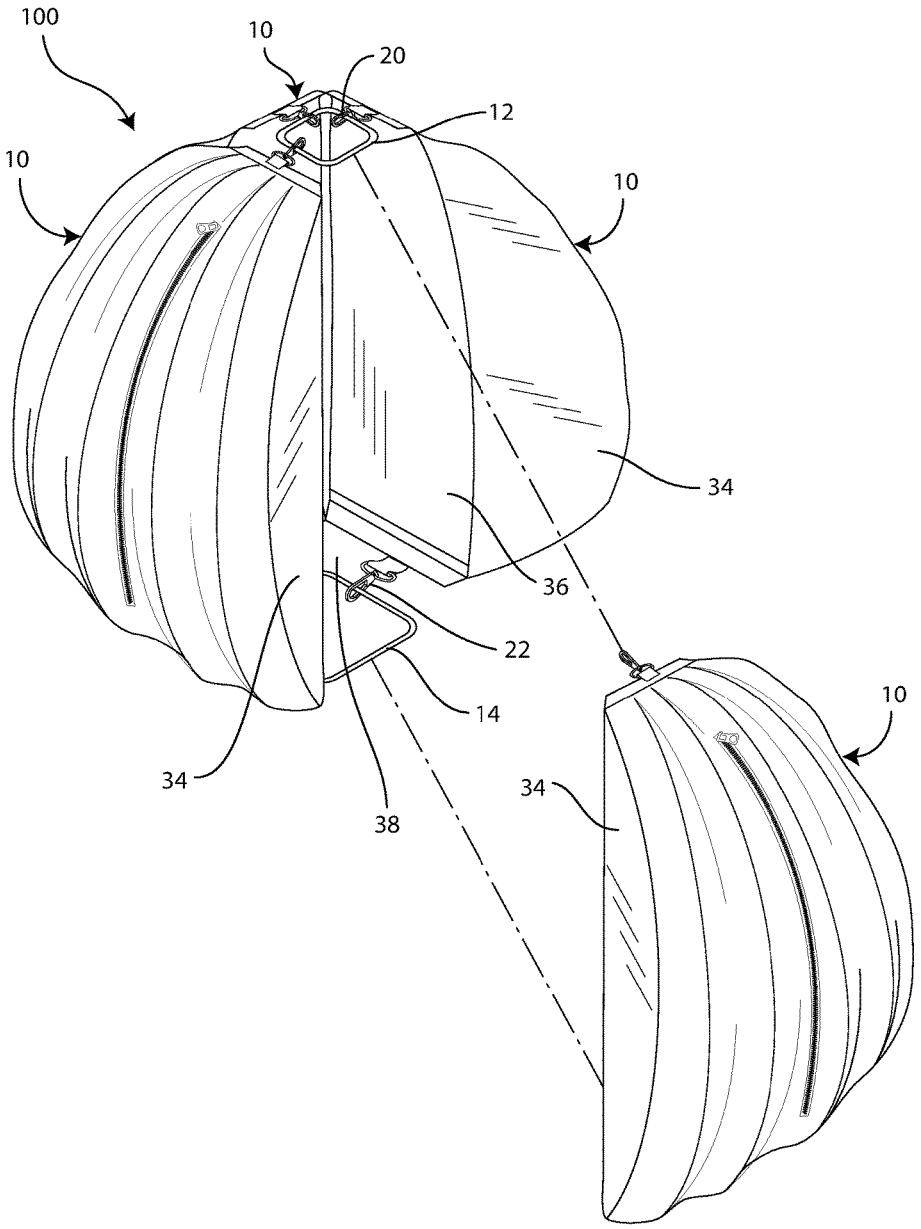
FIG. 6 is a perspective view of travel bag assembly with multiple wedge-shaped, independent bag segments connected at top and bottom rings with a wedge-shaped, independent bag segment detached from assembly.
Figure 7:
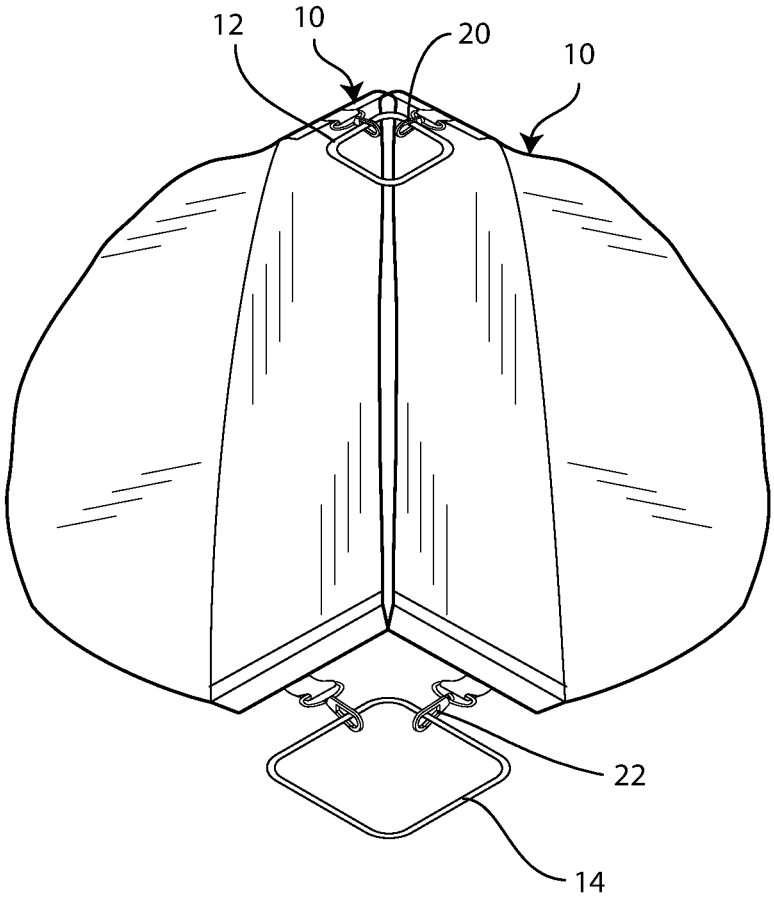
FIG. 7 is a perspective view of travel bag assembly with two wedge-shaped, independent bag segments connected at top and bottom rings.
Figure 8:
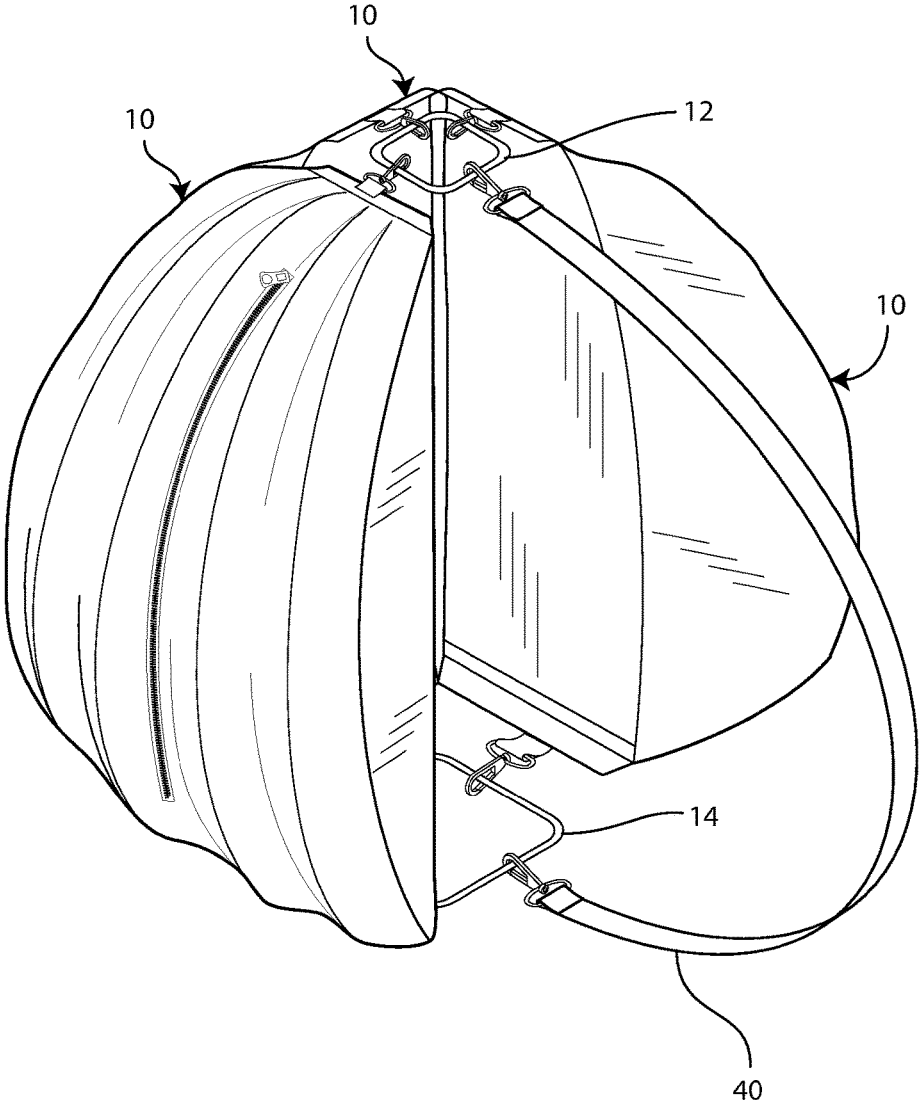
FIG. 8 is a perspective view of travel bag assembly with multiple wedge-shaped, independent bag segments connected at top and bottom rings with strap attached.
Figure 9:
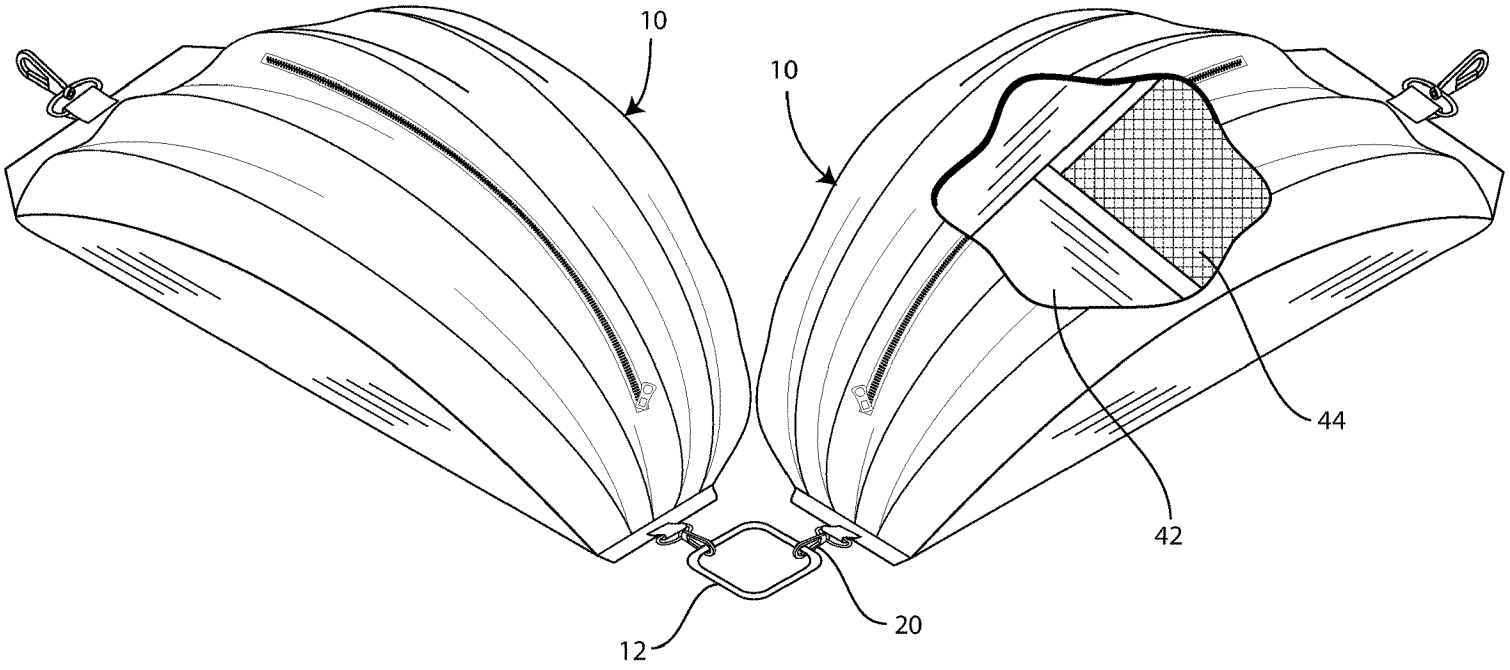
FIG. 9 is a detail view of two wedge-shaped, independent bag segments showing exterior snap hooks, panels and internal mesh panel.

The travel bag assembly of the present invention is illustrated in FIG. 5 with multiple wedge-shaped independent bag segments 10 attached 100, and includes detachable carrying strap(s) 40 FIG. 8. A wedge-shaped, independent bag segment 10, with a top end 16 and bottom end 18 FIG. 1, angled side panels 34 and a back panel 36 FIG. 6 that is structurally shorter in width to the pleated front panel, a pleated 30 front 26 panel FIG. 1 that is structurally longer in width to the back panel, an interior 42 with mesh pocket 44 FIG. 9, and an exterior access entry 32 FIG. 5. Wedge-shaped independent bag segments are vertically assembled 38 at the bottom ring 14 FIG. 6.

Figure 1:
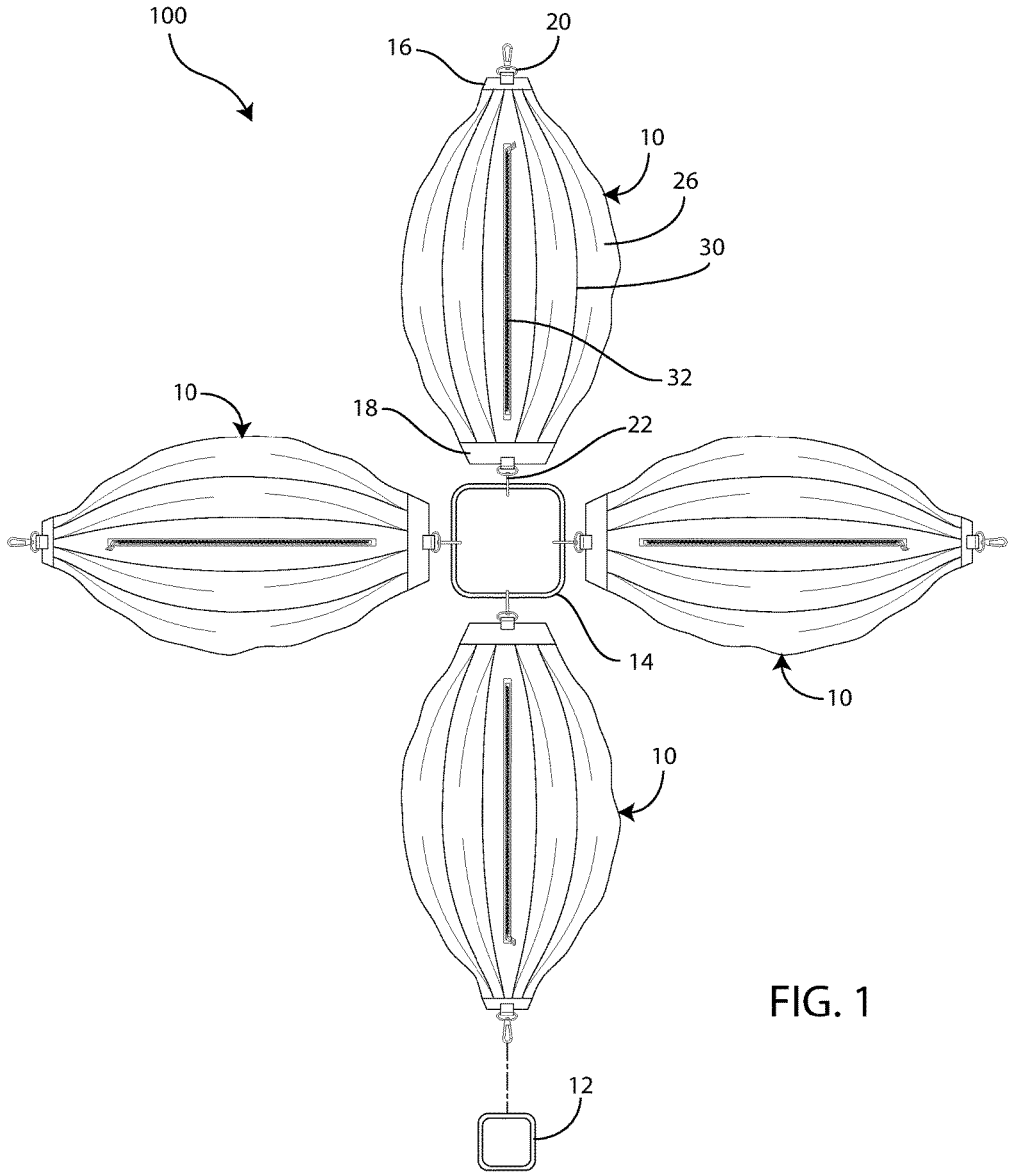
FIG. 1 is top view of travel bag assembly with multiple wedge-shaped, independent bag segments, detached from top ring and laid out flat while still connected at bottom ring.
Figure 2:
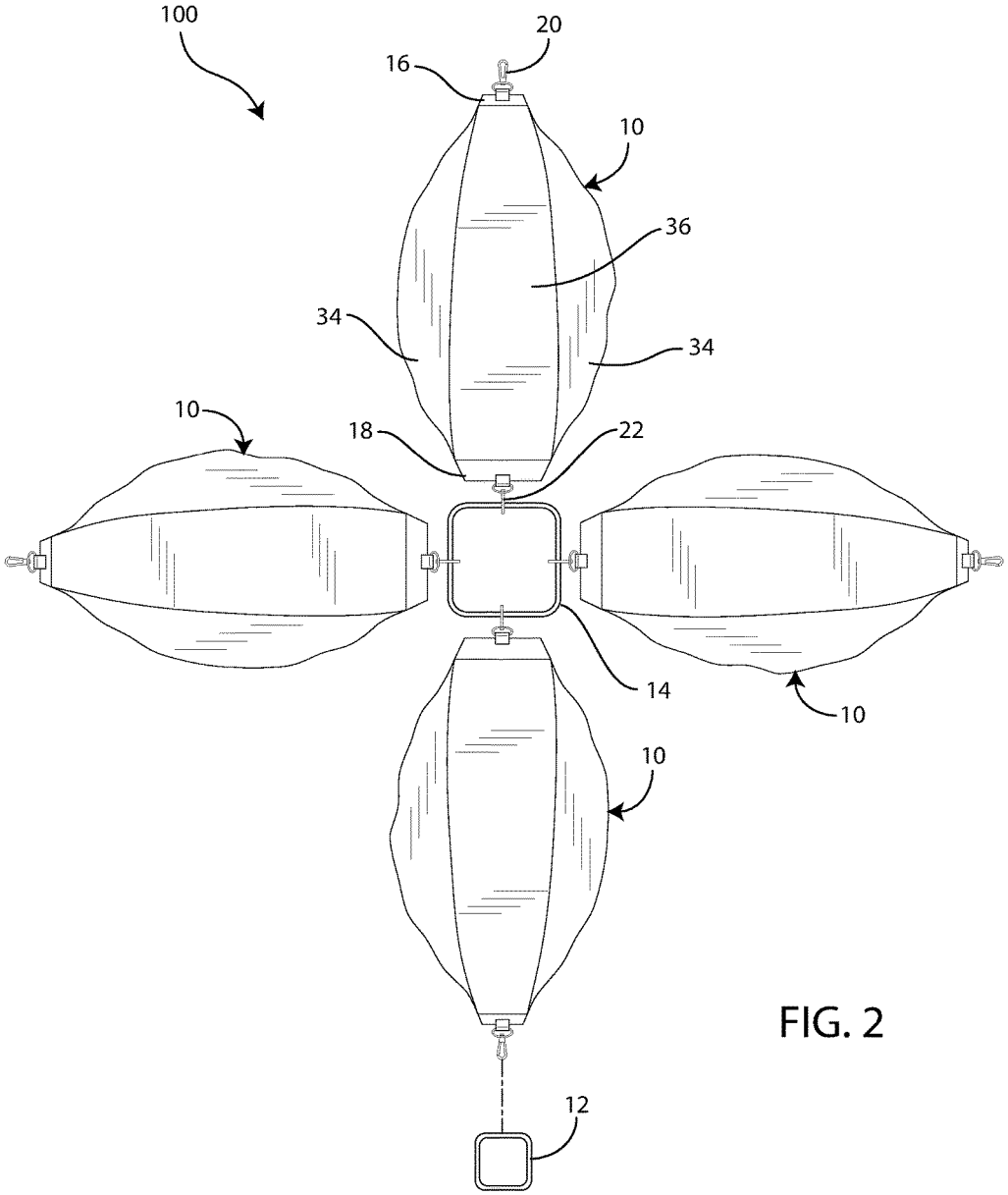
FIG. 2 is a bottom view of travel bag assembly with multiple wedge-shaped, independent bag segments, detached from top ring and laid out flat while still connected at bottom ring.
Figure 3:
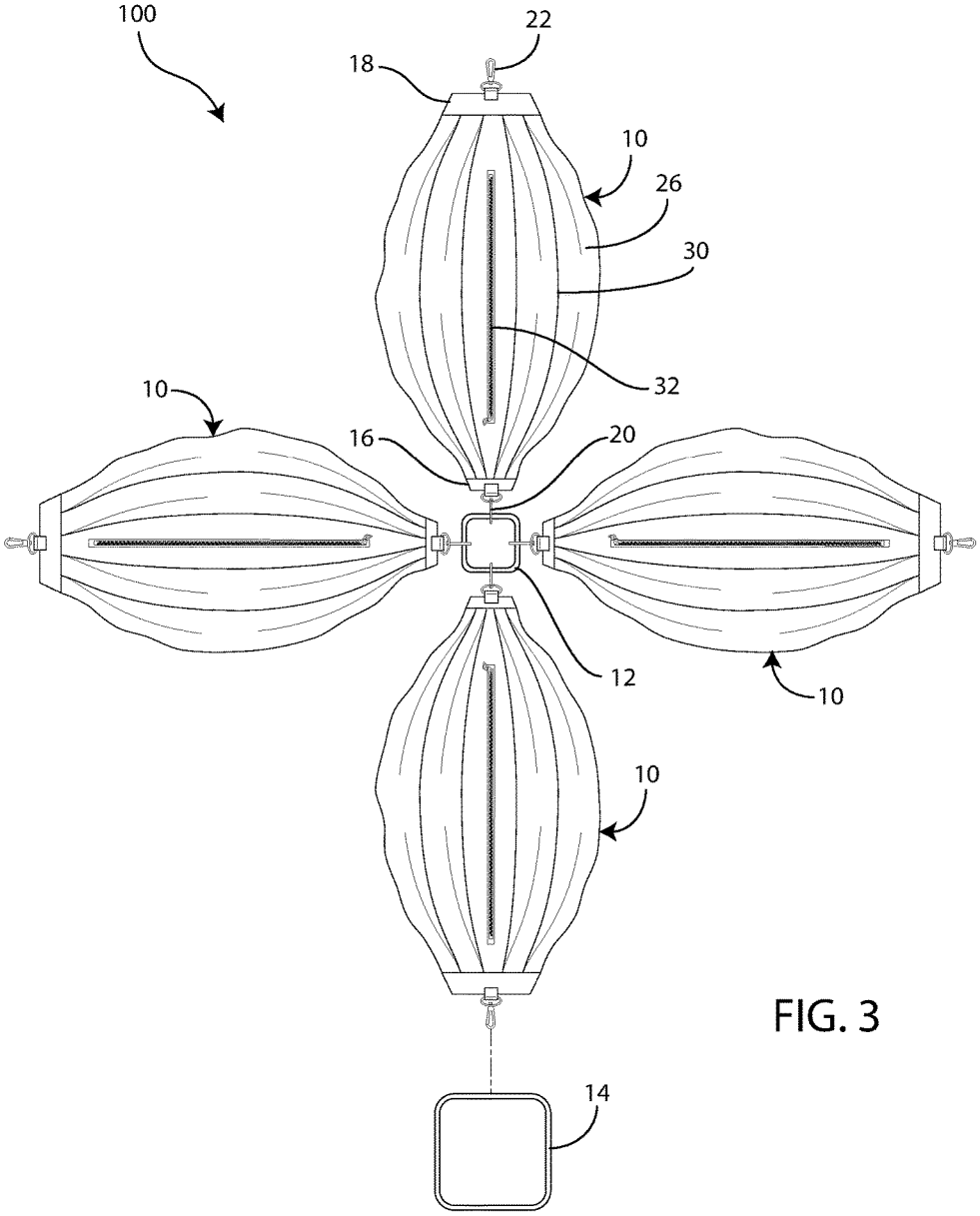
FIG. 3 is a top view of travel bag assembly with multiple wedge-shaped, independent bag segments, detached from bottom ring and laid out flat while still connected at top ring.

Each of the wedge-shaped independent bag segments have a top end 16 with one or more snap hooks attached 20, and each of the wedge-shaped independent bag segments have a bottom end 18 with one or more snap hooks attached 22 FIG. 1.

Figure 4:
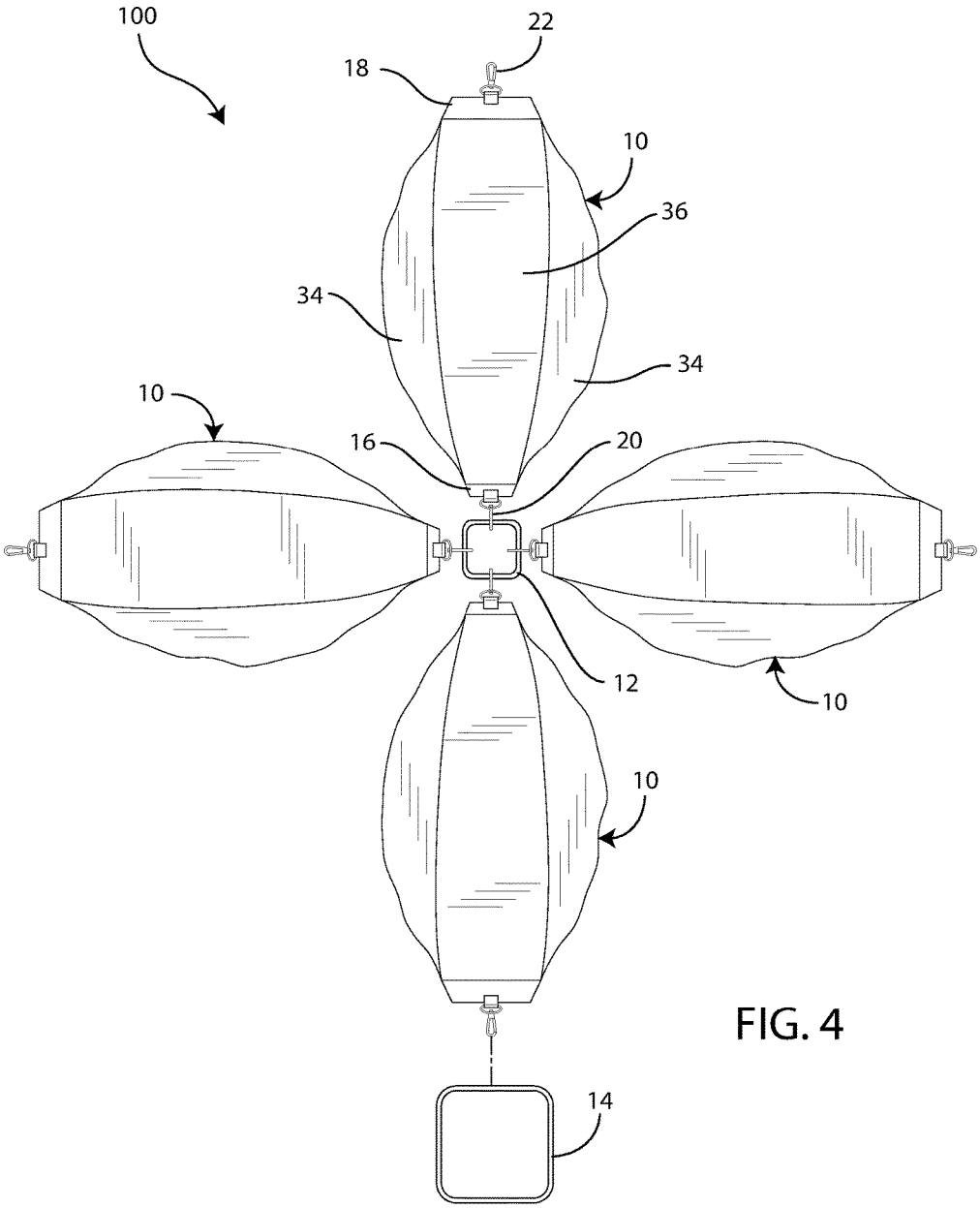
FIG. 4 is a bottom view of travel bag assembly with multiple wedge-shaped, independent bag segments, detached from bottom ring and laid out flat while still connected at top ring.

The top end snap hooks 20 can attach and detach to a top ring 12 FIG. 1 and the bottom end snap hooks 22 can attach and detach to a bottom ring 14 FIG. 4.

The foregoing is illustrative of a preferred form of this invention and it will be understood that this preferred form may be modified and other forms may be provided within the broad spirit of the invention and the broad scope of the claims.

The invention claimed is:

1. A travel bag assembly with wedge-shaped bag segments forming a pumpkin shape, comprising:

a travel bag assembly which includes up to four (4), identical, structurally independent bag segments each comprised of four (4) panels;

each said bag segment has said panels fixedly connected to one another forming a top end, a bottom end, side panel connections, and a bag body interior;

each said bag segment has said panels comprising a back panel, a front panel, and two (2) angled side panels shaped to create an overall wedge shape to each said bag segment;

each said bag segment having an attaching and detaching means at the said top end and said bottom end for connecting to handle means for carrying and lifting the said travel bag assembly or a single said bag segment;

each said bag segment having an attaching and detaching means at the said top end and said bottom end for connecting each of the said bag segments to each other;

each said bag segment having an exterior fastening means for access entry into interior of said bag body interior;

each said bag segment having internal pockets of said bag body interior.

2. The travel bag assembly of claim 1 wherein the said bag segments, when vertically assembled at the said angled-side panels and with said back panels, form an assembly with the overall shape of the said bag assembly resembles a pumpkin shape.

3. The travel bag assembly of claim 1 wherein the said back panel is structurally shorter in width to the said front panel.

4. The travel bag assembly of claim 1 wherein the said front panel is structurally longer in width to the said back panel and has a vertical pleated structure.

5. The travel bag assembly of claim 1 wherein the said side panels are structurally angled from the said back panel connection to the said front panel.

6. The travel bag assembly of claim 1 wherein each of the said bag segments can be detached and reattached of the said travel bag assembly for purposes that each said bag segment can be carried independently of the said travel bag assembly.

* * * * *